US010391647B2

(12) United States Patent
Phoon et al.

(10) Patent No.: US 10,391,647 B2
(45) Date of Patent: Aug. 27, 2019

(54) CUTTING HEAD AND HAIR CUTTING APPLIANCE

(71) Applicant: KONINKLIJKE PHILIPS N.V., Eindhoven (NL)

(72) Inventors: Kin Fatt Phoon, Eindhoven (NL); Roel Alexander Rethmeier, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 41 days.

(21) Appl. No.: 15/547,136

(22) PCT Filed: Jan. 29, 2016

(86) PCT No.: PCT/EP2016/051859
§ 371 (c)(1),
(2) Date: Jul. 28, 2017

(87) PCT Pub. No.: WO2016/124484
PCT Pub. Date: Aug. 11, 2016

(65) Prior Publication Data

US 2018/0021965 A1 Jan. 25, 2018

(30) Foreign Application Priority Data

Feb. 4, 2015 (EP) ..... 15153845

(51) Int. Cl.

| | |
|---|---|
| ***B26B 19/20*** | (2006.01) |
| ***B26B 19/38*** | (2006.01) |
| ***B26B 19/06*** | (2006.01) |
| ***B26B 19/42*** | (2006.01) |

(52) U.S. Cl.
CPC ..... *B26B 19/20* (2013.01); *B26B 19/06* (2013.01); *B26B 19/3813* (2013.01); *B26B 19/42* (2013.01)

(58) Field of Classification Search
CPC ..... B26B 19/20; B26B 19/42; B26B 19/3813; B26B 19/06
USPC ..... 30/43.92, 233, 233.5
See application file for complete search history.

(56) References Cited

U.S. PATENT DOCUMENTS

| | | | | |
|---|---|---|---|---|
| 2,013,279 A | | 9/1935 | Maleev | |
| 2,317,928 A | * | 4/1943 | Martell | B26B 19/20 30/200 |
| 3,041,726 A | | 7/1962 | Hitson | |
| 3,149,418 A | | 9/1964 | Milbourne | |

(Continued)

FOREIGN PATENT DOCUMENTS

EP 0 721 825 A2 * 7/1996

*Primary Examiner* — Hwei-Siu C Payer

(57) ABSTRACT

A cutting head (18) for a hair cutting appliance (10) comprises a blade set (20) including a stationary blade (36) and a cutter blade (38). The stationary blade and the cutter blade comprise at least one toothed leading edge (22,24) jointly defined by respective teeth (62,64) thereof that extend in a longitudinal direction (X). The stationary blade further comprises a front face (58), at the teeth (62) thereof, arranged to face a user's skin, when in operation. A skin protector (76) couples to a housing portion (32) of the cutting head, wherein the skin protector at least partially covers the front face (58) and is arranged to contact the skin, when in operation. The skin protector is movable between a first state and a second state with respect to the blade set (20) and includes an advanced position in the first state and a retracted position in the second state.

17 Claims, 9 Drawing Sheets

(56) References Cited

U.S. PATENT DOCUMENTS

| | | | | |
|---|---|---|---|---|
| 3,267,572 | A | 8/1966 | Cordova | |
| 4,074,427 | A | 2/1978 | Marchetti et al. | |
| 4,118,863 | A | 10/1978 | Sandy | |
| 4,557,050 | A | 12/1985 | Haraguchi et al. | |
| 5,979,060 | A * | 11/1999 | Holzbauer | B26B 19/20 30/200 |
| 6,279,234 | B1 * | 8/2001 | Chaouachi | B26B 19/20 30/200 |
| 2017/0190063 | A1 * | 7/2017 | Schratter | B26B 19/042 |
| 2017/0361476 | A1 * | 12/2017 | Phoon | B26B 19/20 |
| 2018/0021965 | A1 * | 1/2018 | Phoon | B26B 19/20 30/202 |

* cited by examiner

CUTTING HEAD AND HAIR CUTTING APPLIANCE

This application is the U.S. National Phase application under 35 U.S.C. § 371 of International Application No. PCT/EP2016/051859, filed on Jan. 29, 2016, which claims the benefit of International Application No. 15153845.1 filed on Feb. 4, 2015. These applications are hereby incorporated by reference herein.

FIELD OF THE INVENTION

The present invention relates to a cutting head for a hair cutting appliance, particularly an electrically operated head or body grooming appliance, the cutting head comprising a blade set including a stationary blade and a cutter blade, the stationary blade and the cutter blade comprising at least one toothed leading edge jointly defined by respective teeth of the stationary blade and the cutter blade, and wherein the cutter blade can be reciprocally moved with respect to the stationary blade to cut hair. The present disclosure further relates to a hair cutting appliance, particularly an electrically operated head or body grooming appliance, that is fitted with a respective cutting head.

Hair cutting appliances are generally known and may include hair trimmers, hair clippers and shavers. Electric hair cutting appliances may be powered by mains-supplied electricity and/or by batteries. Generally, hair cutting appliances are used to trim facial hair and head hair so as to allow a person to have a well-groomed appearance. To this end, single-purpose hair cutting appliances are well-known, for instance razors, shavers and hair clippers.

In this context, U.S. Pat. No. 3,149,418 A discloses an adjustable comb and gauge attachment for a hair clipper of the type having a plurality of parallel, spaced, fixed blades and a plurality of movable blades cooperating with said fixed blades, said attachment having a planar member of at least the width of the entire plurality of blades of the said clipper, said planar member having a clip on a first end thereof for engagement with the rearmost ends of said fixed blades, said planar member having a plurality of fixed teeth secured in parallel fashion to a second end of said planar member, said teeth being so oriented as to parallel said fixed blades of said hair clipper when said attachment is secured to said hair clipper, each of said teeth having an integral vertical portion secured thereto, each of said integral vertical portions having a resilient material secured thereto along a vertical edge thereof facing said blades when said attachment is secured to the said clipper whereby the front ends of said fixed blades may engage said resilient material at points spaced along said vertical portions to permit said planar member and said teeth to be spaced varying distances from said blades.

It is to be noted that patent application WO2007/132385 A1 discloses a comb device for use with a hair cutting system. The comb as disclosed in WO2007/132385 A1 comprises a first part being in a fixed position with respect to the cutting blades during use of the device; and a second part which is moveable with respect to the cutting blades during use of the device. The first part of the comb device according to WO2007/132385 A1 ensures a constant cutting length while the second part of the comb device improves usability of the comb device.

It is further to be noted that US patent document U.S. Pat. No. 2,013,279 discloses hair clipper attachment which is arranged to move in dependence of the force utilized by the user to press the hair clipping device against the skin during use of the device. The attachment moving with respect to the cutting plate of the hair clipper device such that the cutting length of the device is changed.

Further, in recent years an increased demand for so-called body groomers has been observed. Body groomers or body grooming appliances may be referred to as special purpose hair cutting appliances that may be used to remove, trim or cut body hair in body regions that do not include the neck, face or head of the user. In other words, body grooming appliances may also be referred to as total body hair cutting and/or trimming appliances. Body grooming appliances should be therefore particularly suited for hair cutting operations in the user's sensitive skin areas, for instance in genital areas (intimate hair cutting), in hard-to-reach areas, etc. Further applications for body grooming appliances may be leg shaving and/or underarm shaving. However, the foregoing is not to be understood in a limiting manner, therefore the present disclosure also relates to hair grooming appliances that are primarily arranged to cut or trim facial hair. Total body grooming appliances are, to some extent, also suited for cutting facial hair, while standard hair trimmers/clippers are also, to some extent, applicable for body grooming.

For most hair cutting and/or trimming operations that utilize powered appliances, protection of vulnerable skin regions is of great interest to achieve user acceptance. It has been observed that the user's skin in several body regions is particularly sensitive to treatments with conventional shavers and/or trimmers. Therefore, using conventional out-of-the-shelf shaving and/or head hair cutting appliances may cause significant skin irritations in these sensitive areas.

Furthermore, it has been observed that cutting performance depends to a certain extent on the softness of a currently treated skin region. For instance, when removing hair at relatively hard skin regions that are easily accessible, some users typically tend to accelerate the cutting movement to quickly finish the cutting operation. On the other hand, when removing hair at relatively soft skin regions that all the more may be only hardly accessible, a user typically tends to decelerate the cutting movement of the appliance to avoid damages to the skin. There is a need for hair grooming appliances that show sufficient performance in both application types and that support the user in safely cutting and/or trimming hair.

Consequently, there is still room for improvement in hair grooming appliances.

SUMMARY OF THE INVENTION

It is therefore an object of the present invention to provide a cutting head for a hair cutting appliance, particularly for an electrically operated grooming appliance, which may address at least some of the above-mentioned drawbacks and issues. In particular, it is an object of the present disclosure to provide a cutting head that is particularly suited for hair cutting and/or hair removal in sensitive skin areas and, at the same time, for efficient and powerful hair cutting and/or removal operations in not-so-sensitive skin areas. It would be further advantageous to provide for a cutting head that reduces the risk of skin irritations when cutting hair in sensitive skin areas. Preferably, the risk of skin injuries and/or even skin cuts can be significantly reduced. It is further preferred that the cutting head can be set up to particular grooming applications in sensitive skin regions in a cost-effective manner without adversely affecting the general cutting performance. It is another object of the present disclosure to present a hair cutting appliance, particularly a grooming appliance, that is fitted with a respective cutting head.

In a first aspect of the present disclosure, a cutting head for a hair cutting appliance, particularly an electrically operated grooming appliance, is presented, the cutting head comprising:

a blade set comprising a stationary blade and a cutter blade, the stationary blade and the cutter blade comprising at least one toothed leading edge jointly defined by respective teeth of the stationary blade and the cutter blade, the teeth of the stationary blade and the cutter blade basically extending in a longitudinal direction, wherein the stationary blade further comprises a front face, particularly at the teeth thereof, the front face being arranged to face a user's skin, when in operation, and a skin protector coupled to a housing portion of the cutting head, wherein the skin protector at least partially covers the front face, wherein the skin protector is arranged to contact the skin, when in operation, wherein the skin protector is movable, in response to external forces applied thereto, between a first state and a second state with respect to the blade set, wherein the skin protector is arranged in an advanced position in the first state, and wherein the skin protector is arranged in a retracted position in the second state.

The above aspect is based on the insight that the user's skin typically exhibits different characteristics. Particularly, relatively soft skin portions and relatively hard skin portions may occur. Soft skin portions or respective soft tissue portions may tend to bulge or dome when being contacted by the hair cutting appliance. As a consequence, soft skin portions may, in some cases, be engaged by the toothed leading edge of the appliance. This may therefore cause skin injuries and/or skin irritations. As a precaution, hair cutting appliances may be fitted with skin protectors which may be also referred to as skin guard or comb. A cutting head that is fitted with the skin protector may contact the to-be-treated skin with the skin protector so as to prepare the skin for the following cutting operation. Typically, when a blade set is moved along the skin, so-called skin bulges may be formed that quite likely may enter the cutting zone of the blade set. The more sensitive and softer the skin is, the higher may be the risk of skin bulging or skin doming. As a consequence, the skin protector may be used to smoothen the skin so as to avoid, or at least reduce, the formation of skin bulges and/or skin domes, or to space the skin from the cutting zone. Consequently, the skin irritations may be significantly reduced.

However, typically also relatively hard and/or relatively impervious skin regions may be present. In these skin regions, the cutting performance would be even further increased if no skin protector would be arranged between the blade set and the to-be-processed skin. In conventional hair cutting appliances, this would basically require a detachment of the skin protector. As a consequence, on a case by case basis, the user would have to selectively attach and/or detach the skin protector so as to achieve either the desired cutting performance or skin protection.

In accordance with the above aspect, skin protection and cutting performance are both satisfied as the skin protector is capable of self-adjustment. In other words, the skin protector may be referred to as auto-adjustable skin protector or, more particularly, as continuously or steplessly auto-adjustable skin protector. In other words, the skin protector itself may be automatically set up to the desired state or configuration by the external forces applied thereto that are attributable to a user's contact force and/or to a current softness degree of the skin. Typically, the user applies a certain contact force to the hair cutting appliance when cutting and/or trimming hair. Further, when processing relatively hard skin regions, the user quite likely would apply an increased contact force to sufficiently urge the cutting head into contact with the to-be-processed-skin portion. By contrast, when processing relatively soft skin portions, the user typically would apply lower contact forces to the hair cutting appliance so as to avoid skin irritations and/or skin injuries. Consequently, the skin protector may be operated dependent on the level of a contact force that is applied to the hair cutting appliance.

The first state of the skin protector is particularly suited for processing relatively soft skin portions. The second state of the skin protector is particularly suited for processing relatively hard skin portions. In the first state, a greater portion of the blade set, particularly at the at least one toothed leading edge, is covered or guarded by the skin protector. In the second state, a greater portion of the blade set, particularly of the at least one toothed leading edge, than in the first state is exposed. Consequently, it is more likely in the second state that the front face of the stationary blade actually contacts the skin than in the first state. This may, on the one hand, improve cutting performance when operating at relatively solid skin portions. On the other hand, in the first state, the risk of skin injuries can be significantly reduced.

It is worth noting in this connection that a system formed by the skin protector and the movement mechanism in isolation may form a separate independent aspect of the present disclosure. The skin protector and the movement mechanism may form a system that can be attached to a cutting head and provide the cutting head with improved skin protecting features. Consequently, a cutting head that is fitted with a respective skin protector is particularly suited for hair cutting and/or shaving operations.

Furthermore, at least in the first state, the skin protector may act as a guide for the to-be-cut hair. Generally, the skin protector may comprise a plurality of guide teeth or guide tabs that are aligned with a general orientation of the teeth of the stationary blade. Consequently, hairs can be guided to the stationary blade and cut in a scissor-like cutting operation upon reciprocating movement of the cutter blade with respect to the stationary blade.

Generally, the skin protector may be referred to as skin protecting comb. That is, in respective embodiments, the skin protector comprises a plurality of teeth that are aligned with the teeth of the blade set. However, also alternative embodiments of the skin protector may be envisaged that do not utilize respective guide teeth. Such a device may be referred to as skin protecting bar or skin protecting plate.

As indicated above, the skin protector is moved or adjusted in response to external forces applied thereto. As a consequence, the skin protector may also assume intermediate states or intermediate positions between the first state and the second state. The first state may be therefore regarded as a state of the cutting head in which no external forces or considerably low external forces are applied to the skin protector. Consequently, the second state of the skin protector may be referred to as a state in which considerably large external forces are applied to the skin protector. As a consequence, the user may control the skin protector by adjusting or varying the actual contact force applied through the hair cutting appliance that urges the cutting head of the hair cutting appliance against the to-be-processed skin region.

In one exemplary embodiment, the cutting head further comprises a movement mechanism that is interposed between the skin protector and the housing portion, wherein the movement mechanism movably connects the housing portion and the skin protector. As a consequence, the skin protector is attached to the housing portion in a movable or adjustable fashion. The movement mechanism ensures a defined movement of the skin protector between the first state and the second state. In other words, the movement mechanism may be arranged to transfer or convert an actuation force into a respective response, i.e. a respective adjustment of the skin protector.

In a further refinement of this embodiment, the movement mechanism comprises at least one travel guiding element that is preferably arranged at a lateral end of the skin protector, where the at least one travel guiding element is arranged at a guide slot that is provided at the housing portion, wherein the guide slot defines an allowed direction of linear motion for the travel guiding element with respect to the housing portion. By way of example, the at least one travel guiding element may be arranged as a laterally protruding pin or tab that engages a respective guide slot.

Preferably, the movement mechanism comprises two respective travel guiding elements that are arranged at opposite lateral ends of the skin protector, wherein the travel guiding elements secure the skin protector at the cutting head in a loss-preventing fashion. The travel guiding elements may engage their respective guide slots in a positive locking fashion. As a consequence, though being adjustable and/or movable with respect to the housing portion of the cutting head, the skin protector may be safely retained at the housing portion.

In yet another refinement of the cutting head, the movement mechanism further comprises at least one orientation guiding element that is preferably arranged adjacent to the at least one travel guiding element, wherein the at least one orientation guiding element is received at a guide block that is provided at the housing portion that defines a first orientation of the skin protector in the first state, and a second orientation of the skin protector in the second state. Preferably, the orientation guiding element is arranged to define not only a first orientation and a second orientation of the skin protector but also a first position in the first state and a second position in the second state of the skin protector.

In a further refinement, two respective orientation guiding elements are utilized that are arranged at opposite lateral ends of the skin protector. The at least one orientation guiding element defines respective end positions and/or end orientations of the skin protector in the first state and the second state, respectively.

In a further refinement of the movement mechanism, the guide block defines a first abutment surface that contacts a first contact surface of the orientation guiding element in the first state, wherein the guide block defines a second abutment surface that contacts a second contact surface of the orientation guiding element in the second state. In some embodiments, the orientation guiding element protrudes from a main body of the skin protector, preferably in the lateral direction. Consequently, the guide blocks may be arranged as a laterally extending recess in the housing portion. Conversely, in alternative embodiments, the orientation guiding element may be arranged as a lateral extending recess at the skin protector, whereas the guide block is arranged as a laterally extending protrusion of the housing portion.

It goes without saying that, in some embodiments, at least the orientation element or the guide block may implement or may be composed of two separate entities (elements). In such a case, one of the entities defines the orientation of the skin protector in the first state and the other one defines the orientation of the skin protector in the second state. Consequently, the first abutment surface, the second abutment surface and/or the first contact surface or the second contact surface would be assigned to a respective distinct entity.

Preferably, the first abutment surface and the first contact surface as well as the second abutment surface and the second contact surface cooperate with each other in such a way that the respective orientation of the skin protector is defined in at least two directions in space when the respective elements engage each other.

In yet another exemplary embodiment, the skin protector is movably arranged at the cutting head such that the skin protector, when moving between the first state and the second state, is pivoted and displaced relative to the blade set in a combined movement. Consequently, in accordance with this embodiment, when moving between the first, advanced position and the second, retracted position, the skin protector is not only linearly moved but also pivoted. A respective combined movement includes a rotation (swivel) component and a linear displacement component. This may have the advantage that the skin protector can be even better adapted to its defined function in the first state and the second state, respectively. By way of example, the main body of the skin protector may be at least slightly inclined with respect to the front face of the stationary blade in the first state.

In the second state, the main body of the skin protector may be positioned with respect to the front page of the stationary blade in a substantially flat fashion or parallel fashion. This may be achieved by rotating or pivoting the skin protector when moving the skin protector between the first state and the second state. Furthermore, respective tips of the skin protector, particularly tips of guide teeth thereof, may be substantially aligned in the longitudinal direction with respective tips of the teeth of the stationary blade. However, in the second state of the skin protector, the tips thereof may be shifted with respect to the tips of the teeth of the stationary blade in the longitudinal direction. Consequently, a greater portion of the teeth of the stationary blade is exposed in the second state. A respective longitudinal displacement of the skin protector may be achieved by (linearly) displacing the skin protector but also by applying a combined pivoting/displacing movement of the skin protector.

In yet another exemplary embodiment, at least one limit stop is provided at the housing portion, wherein the skin protector comprises an abutment element that contacts the at least one limit stop in the first state. The at least one limit stop may be embodied by or formed at the guide slot for the travel guiding element, if any, or the guide block for the orientation guiding element.

In yet another embodiment, the skin protector (areally) contacts the stationary blade at the front face thereof in the second state. Consequently, the stationary blade, particularly the front face thereof, may define a respective limit stop for the skin protector in the second state.

In yet another exemplary embodiment, the cutting head further comprises at least one biasing element, particularly at least one spring element, that is arranged to urge the skin protector into the first state. Preferably, the movement mechanism is provided with the at least one biasing element. By way of example, the biasing element may be embodied by a compression spring, a pull spring, a helical spring, a spiral spring, etc. Preferably, two biasing elements are provided that are arranged to contact the skin protector at lateral ends thereof, wherein a contact surface is arranged at, or adjacent to, the at least one orientation guiding element. The biasing element may comprise defined stiffness characteristics which define the force that needs to be applied to the skin protector to move the skin protector between the first state and the second state.

In another refinement of the cutting head, the at least one biasing element generates a linear thrust component and a swiveling component that urge the skin protector into the first state. As a consequence, a single type of resilient elements may be sufficient to induce the combined movement of the skin protector. This may have the advantage that the movement mechanism as such may be composed of only a few components. Preferably, as respective linkage portions may be integrally formed at the skin protector as such and at housing portion as such, only very few additional components are required to implement the movable skin protector. Preferably, only the skin protector as such and one or two biasing elements form additional parts to implement the self-adjustable skin protector at the cutting head.

As indicated above, it may be preferred in some embodiments that at least the position or the orientation of skin protector with respect to the blade set is changed when the skin protector is moved between the first state and the second state.

In yet another embodiment of the cutting head, the at least one toothed leading edge of the stationary blade and a corresponding leading edge of the skin protector maintain a substantially parallel relative orientation when the skin protector is moved between the first state and the second state. Preferably, the toothed leading edge of the stationary blade and the leading edge of the skin protector are brought into alignment in the first state. In the second state, the leading edges may be spaced apart from each other in a parallel fashion.

In yet another embodiment of the cutting head, the skin protector is transferred from the first state to the second state by applying a contact force to the hair cutting appliance when the cutting head is moved along the skin. Consequently, between the skin and the skin protector a respective counterforce may be present that is dependent on the level of the applied contact force. As indicated above, the user typically varies, and may be prompted to adjust, the level of the contact force to a currently perceived softness degree of the skin.

In still another exemplary embodiment, the skin protector is, in the first state, arranged to prevent bulged soft skin portions from contacting cutting edges of the teeth of the stationary blade and the cutter blade, wherein the skin protector is, in the second state, arranged to expose an increased portion of the front face of the stationary blade to increase cutting performance.

In still another embodiment, the skin protector comprises a plurality of guide teeth that are adapted to the teeth of the stationary blade, wherein the guide teeth extend from a main body that extends over the lateral extension of the blade set. The main body may be also referred to as support plate, support piece, support bar, etc. Generally, the guide teeth of the skin protector and the teeth of the stationary blade may assume an at least similar orientation with respect to each other. This may particularly apply when viewed in top plan, i.e. when the plane of projection is parallel to the longitudinal direction and to the lateral direction. By contrast, when viewed from the side, i.e. when the plane of projection is parallel to the longitudinal direction and to the vertical direction, at least in one of the first state and the second state the guide teeth of the skin protector may be at least slightly inclined with respect to the teeth of the stationary blade.

In another embodiment of the cutting head, the number of the teeth at the stationary blade is equal to or greater than the number of the guide teeth at the skin protector, wherein a ratio of the number of the teeth of the stationary blade to the number of the guide teeth at the skin protector is preferably an integer number. In other words, the ratio may be in whole numbers, for instance 1:1, 2:1, 3:1, 4:1, etc.

As a consequence, not necessarily each tooth of the stationary blade needs to be assigned to a respective tab of the skin protector. However, in each case each guide tooth may be aligned with a respective tooth. If, for instance, the above ratio is 2:1, the spaces between the guide teeth of the skin protector may be assigned to and aligned with two spacing slots and a tooth arranged therebetween at the stationary blade.

In yet another embodiment, the blade set, particularly the stationary blade thereof, is coupled to the housing portion in a non-pivotable fashion. As a consequence, typically no change of position and/or orientation of the blade set (particularly the stationary blade thereof) with respect to the housing portion occurs when the skin protector is moved between the first state and the second state.

In yet another embodiment, the skin protector is coupled to the housing portion in a in a detachable fashion. This may involve that the skin protector may be deliberately detached from the cutting head. By way of example, the travel guiding elements that may be arranged at lateral ends of the skin protector may be deflectable such that they may be brought out of engagement with their guide slots such that eventually the skin protector may be removed from the cutting head. This may further facilitate precise cutting and/or trimming operations, particularly styling operations.

In still another exemplary embodiment, the skin protector is arranged as an attachment skin protector that is releasably attachable to the cutting head, wherein the skin protector is preferably an integrally formed part made from resilient material, particularly from plastic material. By way of example, the stationary blade and the cutter blade may be at least partially formed from metal material, particularly from sheet metal material. Since the skin protector is not directly involved in the cutting operation, softer materials, such as plastic material may be utilized. This may have the further advantage that the thermal conductivity of the skin protector is relatively low. Consequently, heat which can be generated in the course of the cutting operation between the cutter blade and the stationary blade basically cannot considerably heat up the skin protector.

The above embodiment can be further developed in that the skin protector comprises at least one snap-on element that is adapted to a corresponding mating portion of a housing portion of the cutting head. Consequently, the attachment and/or detachment of the skin protector can be further facilitated. It may be therefore further envisaged that the cutting head can be fitted with more than one skin protector, wherein respective skin protectors may differ in the number and shape of their guide teeth, for instance.

In yet another embodiment, the blade set of the cutting head comprises two leading edges that are preferably arranged spaced apart from each other in a parallel opposite fashion. Furthermore, the skin protector, particularly the main body thereof, may be shaped such that one of the two leading edges is entirely covered by the skin protector.

Accordingly, the blade set may be referred to as a dual sided blade set, wherein the stationary blade and the cutter blade define a first toothed leading edge and a second toothed leading edge that is facing away from the first leading edge, wherein the first toothed leading edge and the second toothed leading edge are longitudinally spaced from each other, and wherein the skin protector comprises a first arrangement of guide teeth associated with the first toothed leading edge and a second arrangement of guide teeth associated with the second toothed leading edge.

The dual-sided or double-sided arrangement may have the advantage that more body regions may be reached with the cutting head when the cutting head is attached to a hair cutting appliance that comprises a basically elongated but at least slightly curved housing. Furthermore, the user may push and drag the hair cutting appliance, wherein in any case a toothed leading edge of the two toothed leading edges may cut hair. Consequently, both the push phase and the drag phase of a stroke can be used for cutting hair, inactive runs can be reduced. The cutting performance can be thus increased.

According to another aspect of the present disclosure, a hair cutting appliance, particularly an electrically operated hair grooming appliance, is presented, the hair cutting appliance comprising a cutting head and a skin protector in accordance with at least some embodiments as disclosed herein. Generally, the hair cutting appliance may be regarded as an electrically powered hair cutting appliance. Consequently, a motor may be provided for driving the blade set. Typically, the cutter blade which may be also referred to as movable blade is movable with respect to the stationary blade. The cutter blade may be driven with respect to the stationary blade, particularly in an oscillating or reciprocating fashion.

Generally, the hair cutting appliance may comprise an elongated housing that may be at least slightly curved. The housing may further comprise a first end and a second end which is opposite to the first end. At the first end of the housing, a cutting head may be arranged to which the skin protector may be attached. The second end of the housing of the hair cutting appliance may be referred to as handle end. The hair cutting appliance may be referred to as hair trimmer or clipper.

BRIEF DESCRIPTION OF THE DRAWINGS

These and other aspects of the invention will be apparent from and elucidated with reference to the embodiments described hereinafter. In the following drawings

DETAILED DESCRIPTION OF THE EMBODIMENTS

Figure 1:
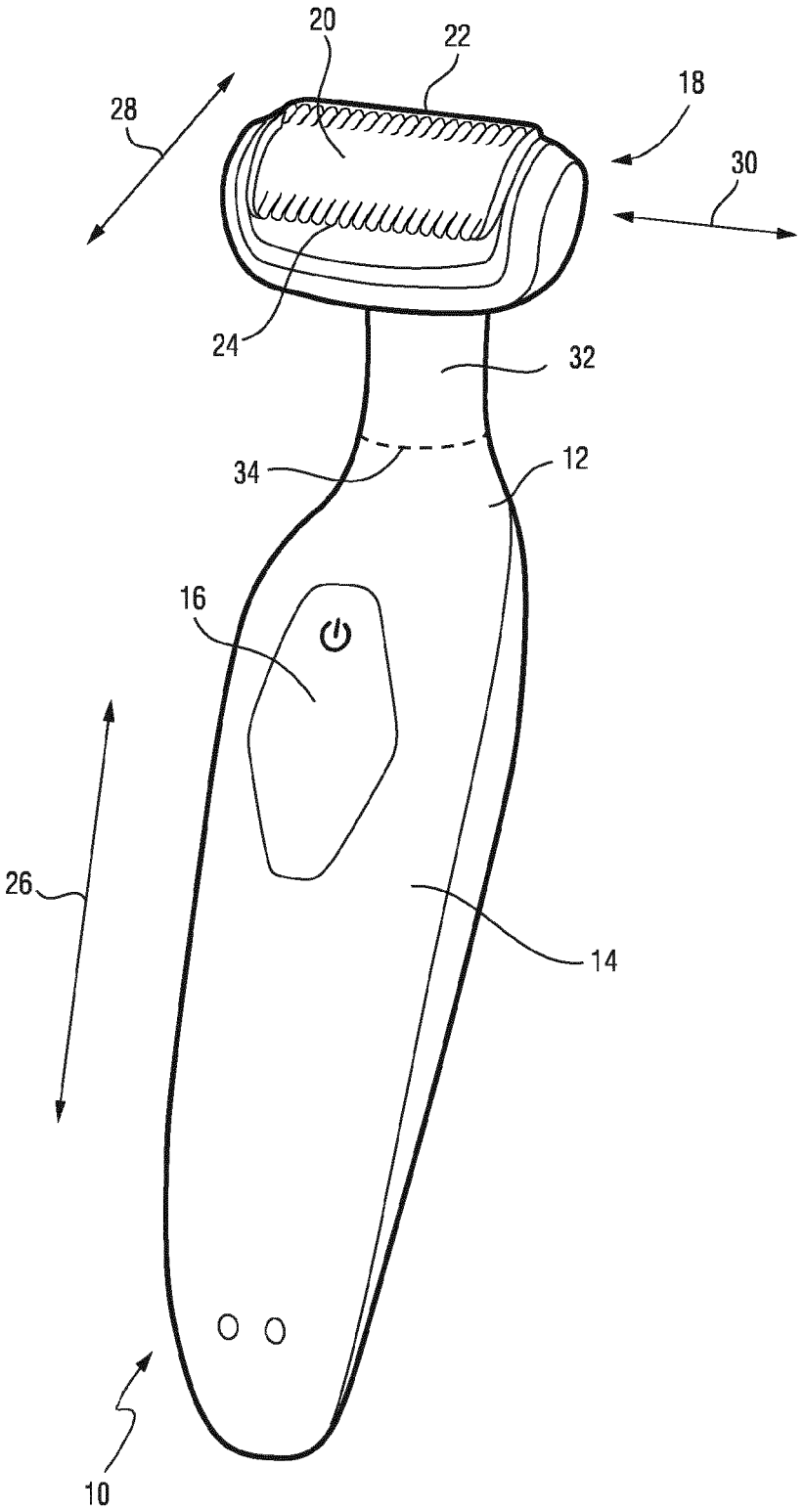
FIG. 1 shows a schematic perspective view of an exemplary embodiment of an electric hair cutting appliance, particularly an electrically operated grooming appliance.

FIG. 1 schematically illustrates, in a simplified perspective view, an exemplary embodiment of a hair cutting appliance 10, particularly a grooming appliance 10. The hair cutting appliance 10 may be primarily intended for cutting facial hair and/or head hair. Alternatively, the hair cutting appliance 10 may be suited for cutting hair in sensitive body regions, such as intimate regions, genital regions, underarm regions, etc. However, also facial hair and/or head hair cutting and/or trimming operations may be envisaged for such an appliance, and vice versa.

The hair cutting appliance 10 comprises an elongated housing 12. The housing 12 comprises a first end and a second end that is opposite to the first end. The second end of the housing 12 may also be referred to as handle end. Generally, the housing 12 may comprise a handle portion 14 where a user may grasp the housing 12. Generally, the housing 12 may be formed in a tubular or shaft-like manner. Furthermore, the housing 12 may be at least slightly curved or banana-shaped in its longitudinal elongated extension.

The housing 12 may further comprise operator controls 16, for instance on/off buttons, etc. At the first end of the housing 12, a cutting head 18 may be provided. The first end of the housing 12 may be therefore also referred to as neck portion. As indicated in FIG. 1, the cutting head 18 may comprise a blade set 20. The blade set 20 may define at least one toothed leading edge 22, 24. In FIG. 1, the blade set 20 defines a first toothed leading edge 22 and a second toothed leading edge 24 that is facing away from the first toothed leading edge 22.

For the purpose of cutting hair, a user may grasp the housing 12 of the hair cutting appliance 10 at the handle portion 14 and move the cutting head 18 through hair in a moving direction indicated by reference numeral 28. An ideal moving direction 28 may be generally perpendicular to a lateral direction (indicated by reference numeral 30) which may also be referred to as direction of the cutting motion of the blade set 20. A housing portion of the cutting head 18 is indicated in FIG. 1 by reference numeral 32. Furthermore, a dashed line indicated by reference numeral 34 illustrates an attachment interface 34 where the cutting head 18 may be attached to the housing 12. In some embodiments, the cutting head 18 may be releasably attached to the housing 12. However, in alternative embodiments, the cutting head 18 may be permanently and fixedly attached to the housing 12. Consequently, in these embodiments no attachment interface 34 needs to be provided.

In FIG. 1, a main direction of the longitudinal/elongated extension of the housing 12 is indicated by reference numeral 26. The housing 12 may be at least slightly inclined and/or curved. As a consequence, the cutting head 18 and the blade set 20 may be at least slightly inclined with respect to a plane that is perpendicular to the elongation direction 26. Taking into account that the blade set 20 may define a first toothed leading edge 22 and a second toothed leading edge 24, the user or operator of the hair cutting appliance 10 may therefore operate the hair cutting appliance 10 in at least two distinct operation orientations. This may further facilitate reaching remote and hard-to-reach skin areas.

The housing 12 may further house a driving mechanism for the blade set 20. The driving mechanism (not shown in FIG. 1) may comprise an electric motor and a force transmission unit that may couple the motor and the blade set 20. Furthermore, an internal control unit may be provided. The hair cutting appliance 10 may be battery powered and/or mains-operated/line-powered. Consequently, at least in some embodiments, the housing 12 may further house a battery unit. Preferably, the hair cutting appliance 10 is designed in a water-proof fashion. This may include that the user may operate the hair cutting appliance 10 in a basically wet or moisty environment, for instance, in a bath tube or a shower.

Figure 2:
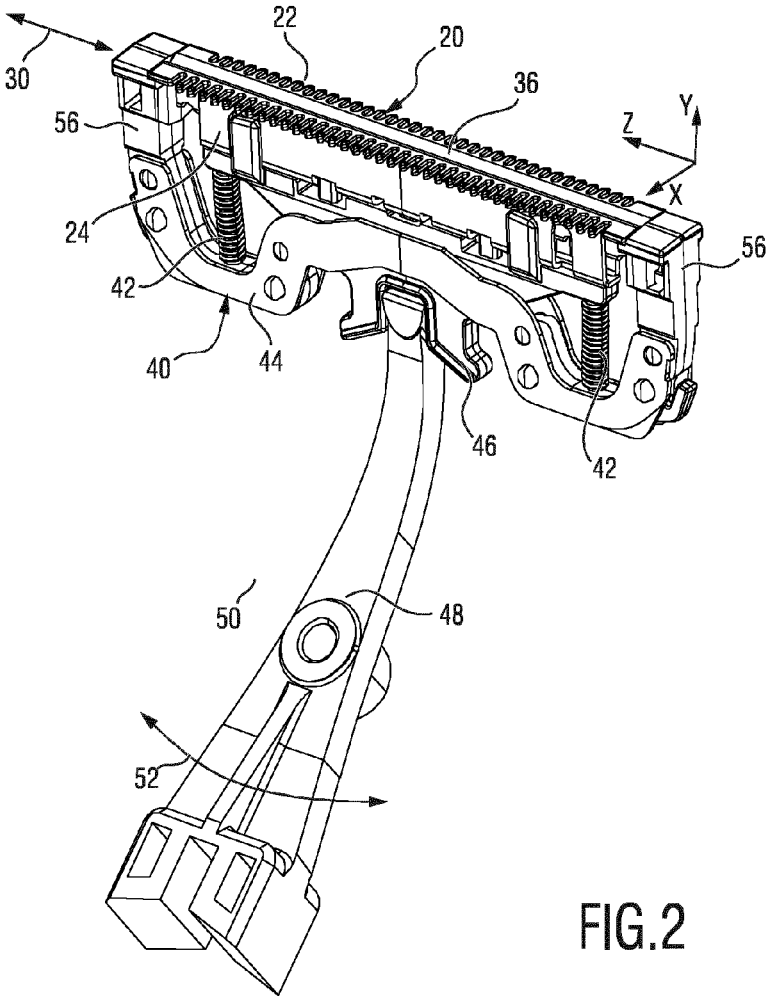
FIG. 2 shows a perspective view of a blade set for a hair cutting appliance that can be driven by a drive mechanism.

For ease of reference, coordinate systems are indicated in several drawings herein. By way of example, a Cartesian (right-hand) coordinate system X-Y-Z is indicated in FIG. 2. An axis X of the respective coordinate system extends in a generally longitudinal direction that is generally associated with length, for the purpose of this disclosure. An axis Y of the coordinate system extends in a height (or vertical) direction which may be referred to for illustrative purposes, at least in some embodiments, as a generally vertical direction. An axis Z of the coordinate system extends in a lateral (or transverse) direction associated with width, for the purpose of this disclosure. It goes without saying that an association of the coordinate system X-Y-Z to characteristic features and/or embodiments of the hair cutting appliance 10 is primarily provided for illustrative purposes and shall not be construed in a limiting way. It should be understood that those skilled in the art may readily convert and/or transfer the coordinate system provided herein when being confronted with alternative embodiments, respective figures and illustrations including different orientations. It is further worth mentioning that, for the purpose of the present disclosure, the coordinate system X-Y-Z is generally aligned with main directions and orientations of the cutting head 18 including the blade set 20.

Figure 3:
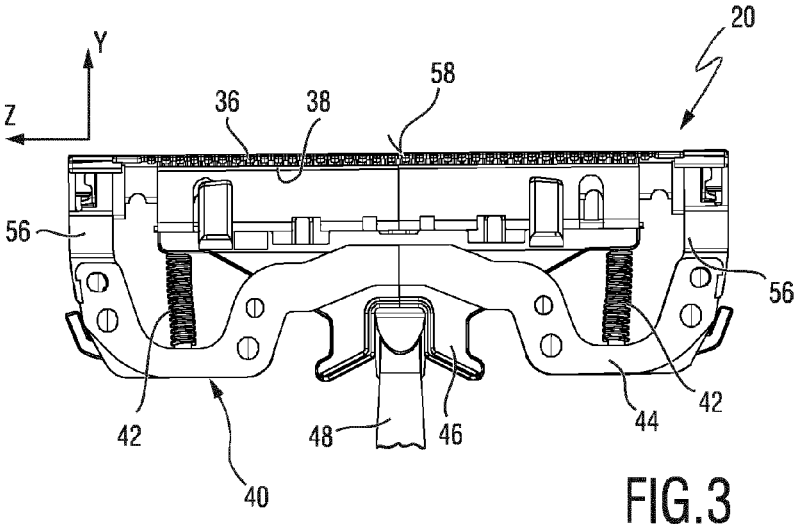
FIG. 3 shows a longitudinal side view of the blade set in accordance with FIG. 2.
Figure 4:
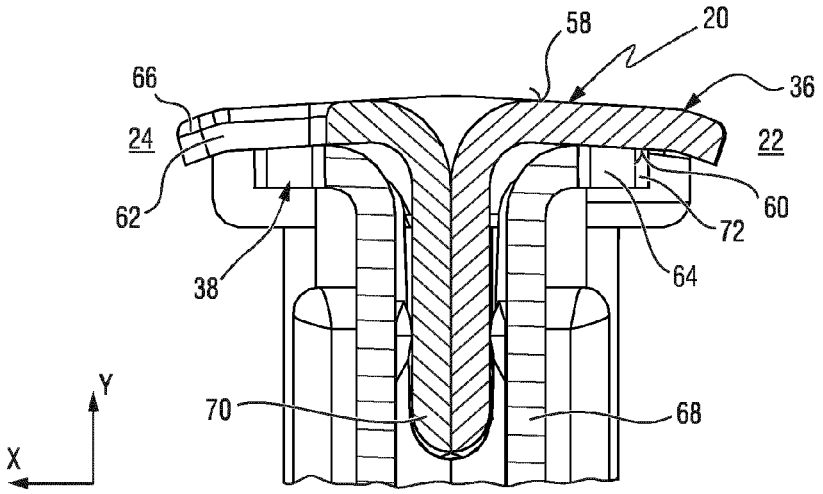
FIG. 4 shows a partial cross-sectional lateral side view of a blade set in accordance with FIGS. 2 and 3.
Figure 5:
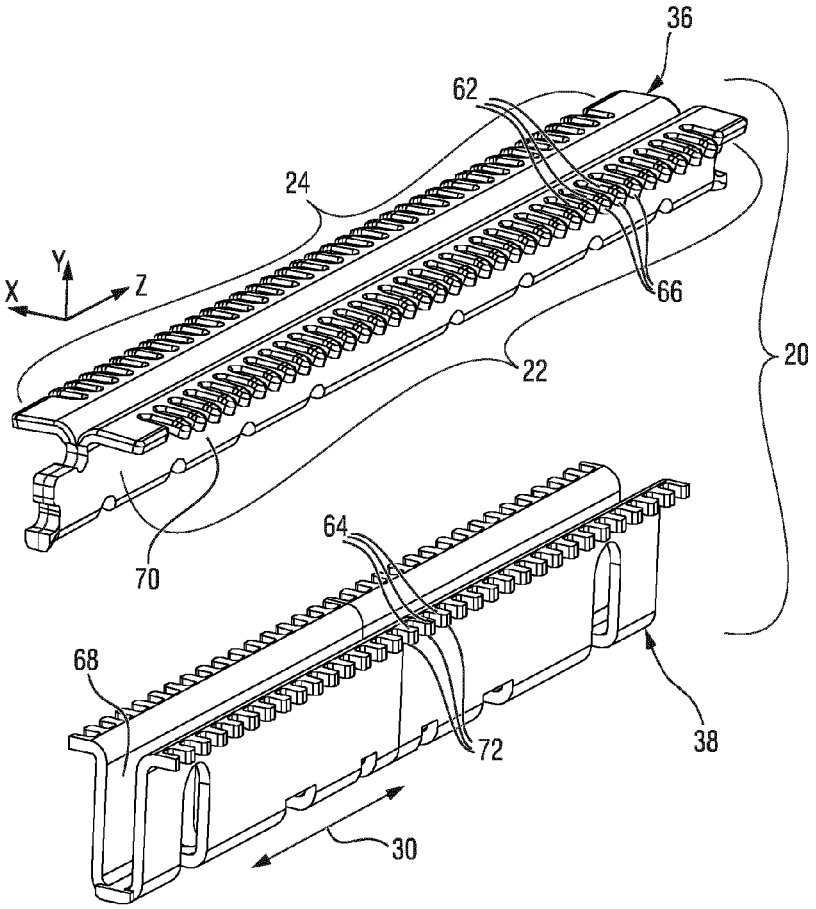
FIG. 5 shows a perspective view of a stationary blade and a cutter blade of the blade set, the stationary blade and the cutter blade shown in an exploded state.

Further reference is made to FIGS. 2 to 5. FIG. 2 is a perspective view of a blade set 20 that may be implemented in the cutting head 18 illustrated in FIG. 1. The blade set 20 comprises a stationary blade 36 and a cutter blade 38 that may be moved with respect to each other in a cutting direction 30 which is basically parallel to the lateral direction Z to cut hair. The stationary blade 36 and the cutter blade 38 are illustrated in FIG. 5 in more detail in an exploded state.

Reference is again made to FIG. 2 and to FIG. 3. The blade set 20 further comprises a receiving frame 40 which may form a base for the stationary blade 36. The receiving frame 40 may comprise a support bow or support bracket 44 that may be coupled to the housing portion 32 of the cutting head 18, refer also to FIG. 6. The support bracket 44 may, on the one hand side, receive the stationary blade 36, directly or in a mediate fashion. The stationary blade 36 may be arranged to be fixed to the support bracket 44. Consequently, no relative motion between the support bracket 44 and the stationary blade 36 is intended when operating the blade set 20.

As can be best seen from FIGS. 3 and 4, also the cutter blade 38 may be arranged at the receiving frame 40. However, the cutter blade 38 may be received in a movable manner, particularly in a slidingly movable manner. The cutter blade 38 may be moved with respect to the stationary blade 36 in the cutting direction 30. To this end, the cutter blade 38 may be attached to a transmitter 46 that may be engaged by a driver 48 of the driving mechanism. By way of example, the driver 48 may be arranged as a pivotable driving lever that can be mounted to a pivoting axis 50 which may be attached or coupled to the housing 12 (not shown in FIG. 2). A driving pivoting motion of the driver 48 about the axis 50 is indicated in FIG. 2 by reference numeral 52. Consequently, an oscillating swiveling motion of the driver 48 can be transferred into a reciprocating slide motion of the cutter blade 38 with respect to the stationary blade 36. At an input end of the driver 48 that is opposite to an output end that is coupled to the transmitter 46, a motor, particularly an eccentric portion of an output shaft thereof, may engage the driver 48. As can be best seen in FIG. 2, the driver 48 may be at least slightly curved. As a consequence, the blade set 20 may be at least slightly inclined with respect to an orientation of an output shaft of a respective electric motor.

Furthermore, at least one biasing element 42 may be arranged between the support bracket 44 and the cutter blade 38. The biasing element 42, particularly a first and a second biasing element 42 may actually urge the cutter blade 38 into contact with the stationary blade 36 to improve the cutting performance. Furthermore, the biasing element 42 may apply a reset force to the cutter blade 38 and, furthermore, cushion or attenuate the movement of the cutter blade 38. This may have a positive impact on the cutting performance and on the running noise of the blade set 20.

At lateral ends of the blade set 20, lateral connectors 56 may be provided that connect the support bracket 44 and the stationary blade 36. The first toothed leading edge 22 and the second toothed leading edge 24 of the blade set 20 may generally extend in the lateral direction Z. The first toothed leading edge 22 and the second toothed leading edge 24 may be spaced from each other in the longitudinal direction X.

As can be best seen from FIG. 4, the stationary blade 36 and the cutter blade 38 are stacked in the vertical direction or height direction Y. A front face of the stationary blade 36 is indicated in FIG. 3 by reference numeral 58. The front face 58 is the side or surface of the stationary blade 36 that is typically facing the skin when the blade set 20 is in operation. A rear face which is typically facing away from the front face 58 is indicated in FIG. 3 by reference numeral 60. The cutter blade 38 contacts the stationary blade 36 at the rear face 60 thereof.

As can be further seen from FIG. 4, respective portions of the stationary blade 36 that are associated with the first toothed leading edge 22 and the second toothed leading edge 24 may be at least slightly inclined and/or curved. Hence, the front face 58 and the rear face 60 do not necessarily have to be perfectly parallel to each other and/or to a plane that is defined by the longitudinal direction X and the lateral direction Z. However, it may be assumed that the front face 58 and the rear face 60 are substantially parallel to the aforementioned plane X-Z.

With particular reference to FIG. 4 and to FIG. 5, an exemplary embodiment of the blade set 20 is further detailed. The toothed leading edges 22, 24 of the blade set 20 may be formed by a series of teeth 62 of the stationary blade and a corresponding series of teeth 64 of the cutter blade. The teeth 62, 64 may basically extend in the longitudinal direction X. A row or series of teeth 62, 64 may basically extend in the lateral direction Z and form a corresponding leading edge 22, 24. Between the teeth 62, 64, respective tooth spaces or slots may be provided. Hairs may enter the slots and then be cut due to the relative motion of the cutter blade 38 with respect to the stationary blade 36. Tips of the tooth 62 of the stationary blade 36 are indicated by reference numeral 66 in FIGS. 4 and 5. Tips of the teeth 64 of the cutter blade 38 are indicated in FIGS. 4 and 5 by reference numeral 72. Both the teeth 62 of the stationary blade 36 and the teeth 64 of the cutter blade 38 may comprise, at least at their lateral sides, cutting edges that are facing each other and may come into contact to cut hair in a scissoring or shearing action when the cutter blade 38 is moved with respect to the stationary blade 36.

As can be further seen from FIGS. 4 and 5, the cutter blade 38 may comprise a basically U-shaped frame body forming a guide or slide slot 68. At the ends of the U-shaped profile, toothed portions may be provided that form the leading edges 22, 24 with the respective teeth 62 of the stationary blade 36. Generally, the cutter blade 38 may be obtained from a sheet metal blank that may be formed and processed accordingly.

The stationary blade 36 may be composed of two portions that may be shaped and connected or bonded in a bird's wing-like fashion. Each of the components may eventually form the teeth 62 of one of the first toothed leading edge 22 and the second toothed leading edge 24, respectively. Each of the wing-shaped components may comprise a basically L-shaped section. Both components may be adequately attached to each other, for instance, via bonding, welding, etc. Consequently, the stationary blade 36 may comprise a basically T-shaped profile that extends in the lateral direction Z. A stem of the T-shaped profile may define a guide support 70 that is arranged to cooperate with the guide or slide slot 68 of the cutter blade 38. In the assembled state, the guide support 70 may be inserted in the slide slot 68. Consequently, the stationary blade 36 may provide a protruding guide for the cutter blade 38 that engages a corresponding slot thereof. The cutter blade 38 may be moved with respect to the stationary blade 36 in a reciprocating fashion in the lateral direction Z. A guide support in the longitudinal direction X and the vertical direction Y is provided by the stationary blade 36. The biasing elements 42 may urge the cutter blade 38 against the stationary blade 36 into abutment. Consequently, the longitudinal and the vertical position of the cutter blade 38 may be sufficiently defined.

The exemplary embodiment of the blade set 20 as shown in FIGS. 1 to 5 implements two toothed leading edges 22, 24. However, this shall not be understood in a limiting sense. There may be alternative exemplary embodiments that implement a single toothed leading edge.

Figure 6:
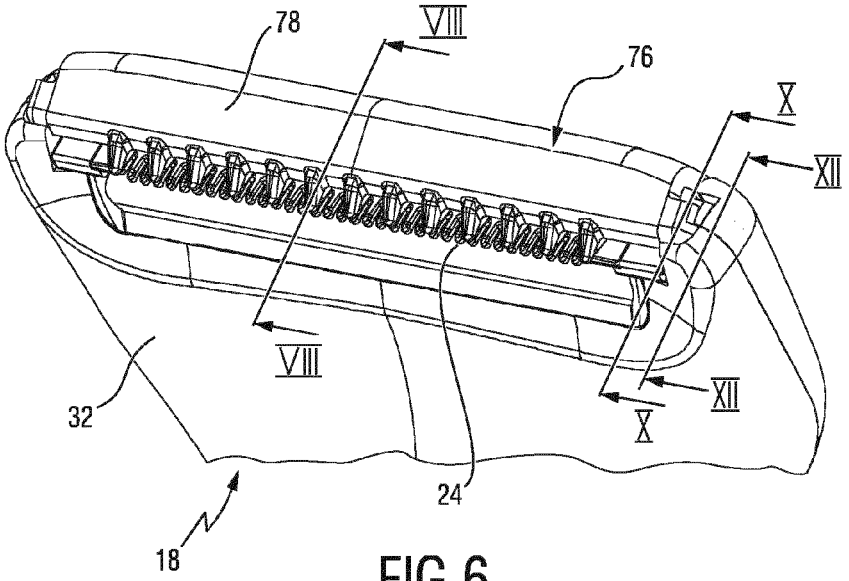
FIG. 6 shows a perspective view of an embodiment of a cutting head for a hair cutting appliance, the cutting head being fitted with a skin protector, wherein the skin protector is shown in a first state.
Figure 7:
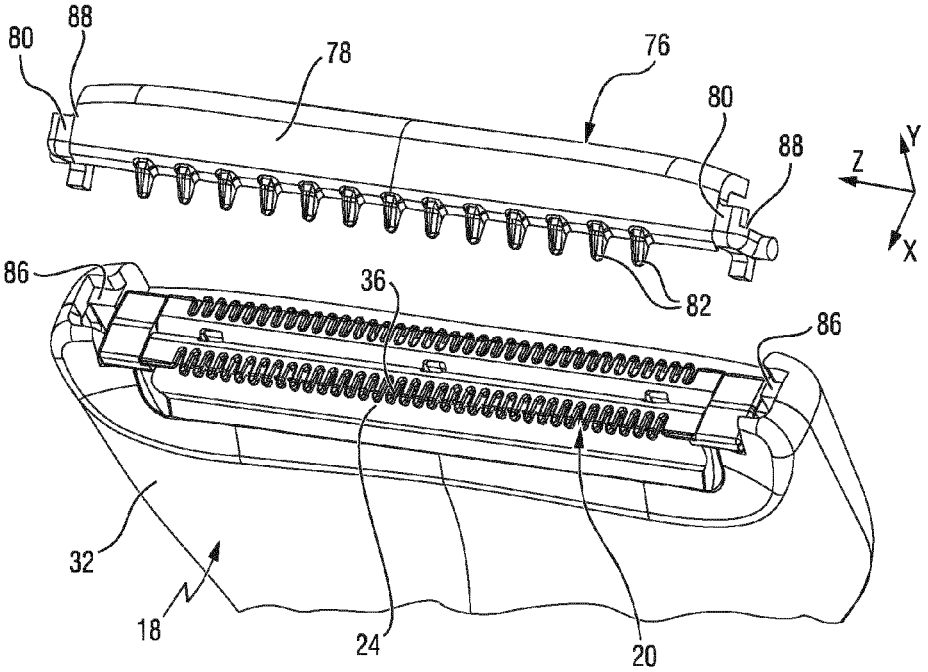
FIG. 7 shows another view of the arrangement of the cutting head illustrated in FIG. 6, wherein the skin protector is shown in a detached state.

Further reference is made to FIGS. 6 to 17. FIG. 6 and FIG. 7 illustrate a partial perspective view of an exemplary embodiment of a cutting head 18 that may be arranged in accordance with the arrangement illustrated in FIGS. 2 to 5. Particularly, the cutting head 18 may utilize a blade set 20 and a receiving frame 40 that may be engaged by a driving mechanism 48 as already explained hereinbefore.

FIG. 6 and FIG. 7 basically illustrate a view of the cutting head 18 in the same orientation. In FIG. 6, a skin protector 76 is attached to the cutting head 18, particularly to a housing or housing portion 32 thereof. The skin protector 76 is illustrated in a detached or released state in FIG. 7 for illustrative purposes. In the embodiment(s) of FIGS. 6 to 17 as explained and discussed herein, the blade set 20 of the cutting head 18 is basically arranged at the cutting head 18 in a non-pivotable fashion. In other words, in accordance with this embodiment, the cutting head 18 does not provide a so-called contour-following capability. Rather, the blade set 20, particularly the stationary blade 38 thereof, may be attached or coupled to the housing portion 32 in a relatively fixed fashion.

The skin protector 76 may be arranged as a single (integrally formed) component. The skin protector 76 may comprise a main body 78 that may basically extend over a lateral extension (extension in the Z-direction) of the blade set 20. As shown in FIG. 6, the skin protector 76, particularly the main body 78 thereof, may cover at least a portion of the stationary blade 36, particularly of the front face 58 thereof. The skin protector 76 may comprise a plurality of guide teeth 82 that may extend from the main body 78. Particularly, the guide teeth 82 may basically extend in the longitudinal direction X. In other words, the guide teeth 82 may be basically aligned with the teeth 62 of the stationary blade 36, refer also to FIG. 5. However, the number of guide teeth 82 does not necessarily has to correspond to the number of teeth 62. In other words, the number of teeth 62 of the stationary blade 36 may be a multiple of the number of guide teeth 82. Consequently, for instance each second, third, fourth or fifth tooth 62 of the stationary blade 36 may be associated with a respective guide tooth 82 of the skin protector 76.

When viewed in top view, at least in a first state as shown in FIG. 6, the (lateral) position or Z-position of the guide teeth 82 preferably corresponds to the (lateral) position or Z-position of their respective associated teeth 62 at the stationary blade 36. At the frontal end of the housing portion 32, at least one receiving portion 86, preferably two opposite receiving portions 86, may be provided that are arranged to receive and engage the skin protector 76. As can be best seen in FIG. 7, the skin protector 76 may comprise, at respective lateral ends 80 of the main body 78, at least one respective engagement portion 88 that is arranged to engage the receiving portion 86 of the housing portion 32.

In some embodiments, the skin protector 76 may be permanently attached to the housing portion 32. In other words, the skin protector 76 may be secured at the housing portion 32. This involves that the user cannot deliberately remove or detach the skin protector 76 in a normal operation mode of the hair cutting appliance 10. However, in some alternative embodiments, the skin protector 76 may be releasably attached to the housing portion 32. As a consequence, depending on an actual type of application, the user may selectively attach the skin protector 76 to the housing portion 32 and therefore to the cutting head 18. However, when the skin protecting capabilities of a respectively equipped cutting head 18 are of no use or of only little use, the user may remove the skin protector 76 to achieve an improved cutting performance.

As the skin protector 76 is arranged as a moveable and/or adjustable skin protector 76, the user may profit from the skin protector 76 in most cases of application as the skin protector 76 is self-adjustable to relatively soft and to relatively hard skin portions.

Figure 8:
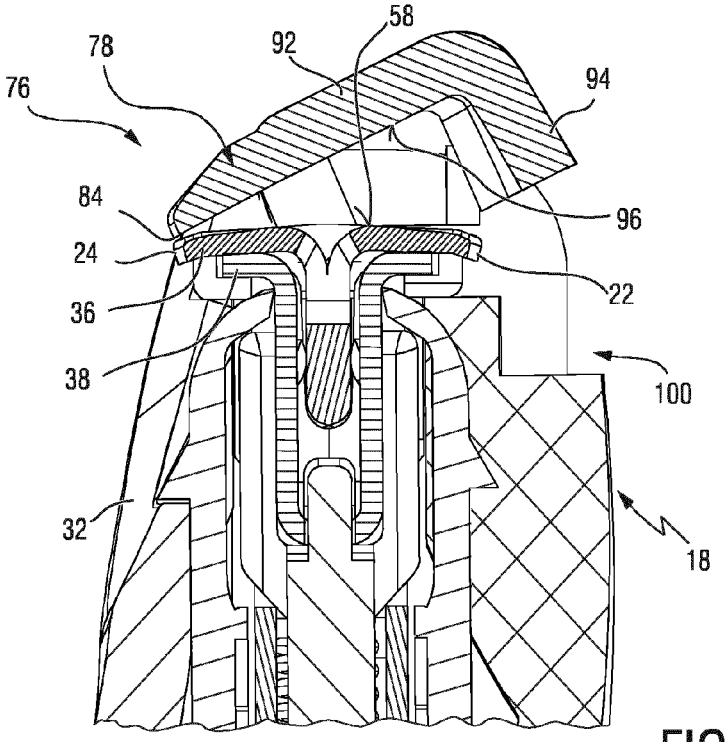
FIG. 8 shows a partial cross-sectional lateral side view of a central region of the arrangement of the cutting head illustrated in FIG. 6, wherein the skin protector is shown in a first state.
Figure 9:
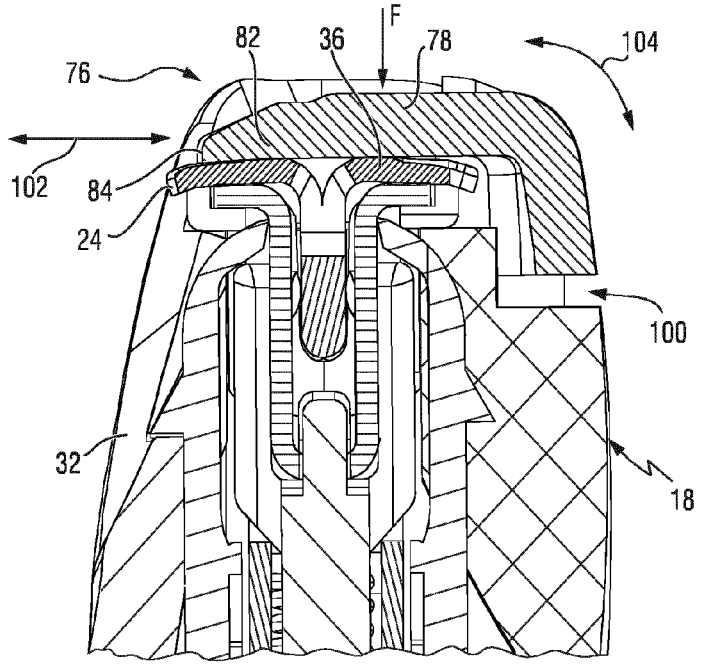
FIG. 9 shows another cross-sectional lateral side view of the arrangement illustrated in FIG. 8, wherein the skin protector is shown in a second state.
Figure 10:
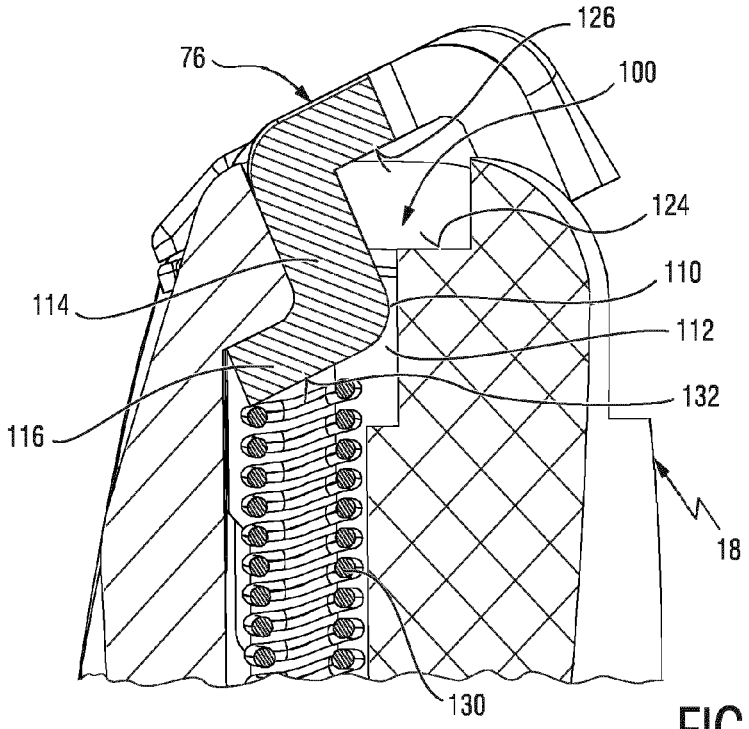
FIG. 10 shows another partial cross-sectional lateral side view of a lateral end region of the arrangement of the cutting head illustrated in FIG. 6, wherein the skin protector is shown in the first state.
Figure 11:
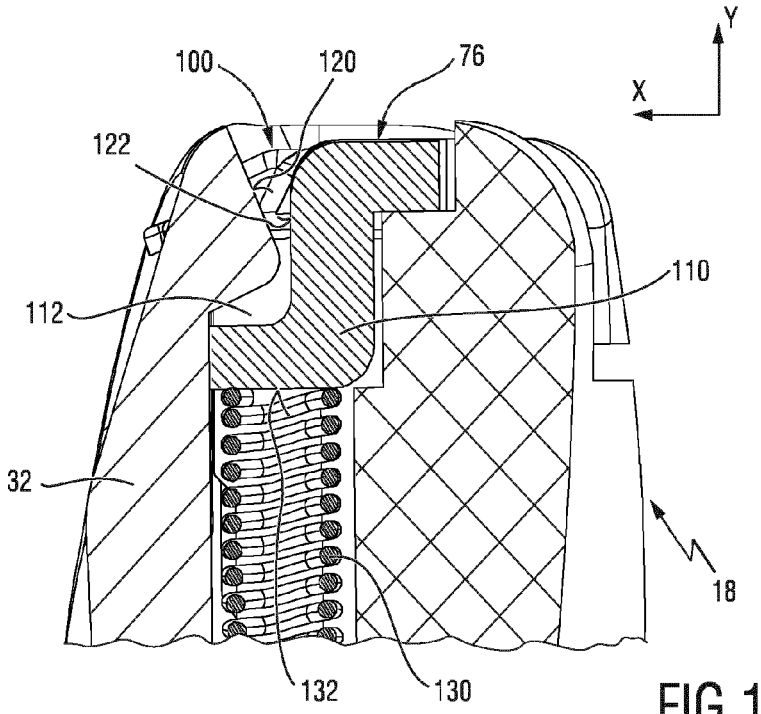
FIG. 11 shows another cross-sectional side view of the arrangement illustrated in FIG. 10, wherein the skin protector is shown in the second state.
Figure 13:
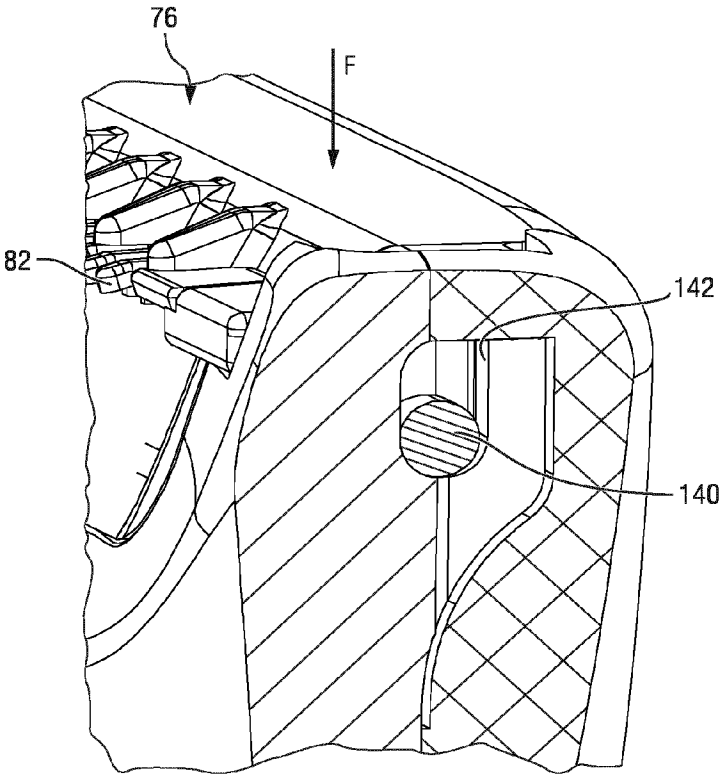
FIG. 13 shows another perspective cross-sectional side view of the arrangement illustrated in FIG. 12, wherein the skin protector is shown in the second state.
Figure 12:
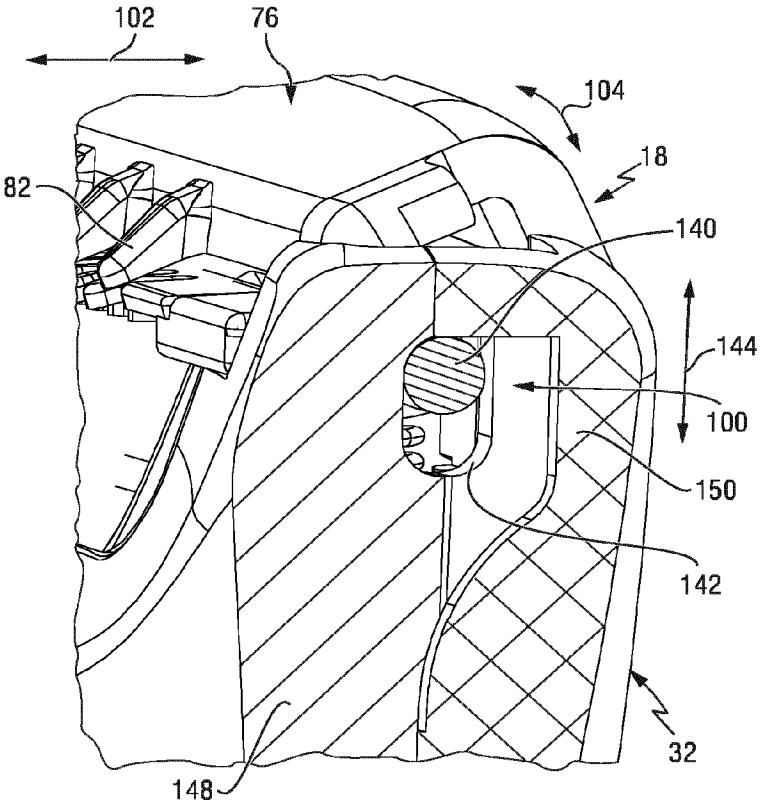
FIG. 12 shows a perspective cross-sectional lateral side view of a lateral end region of the arrangement of the cutting head illustrated in FIG. 6, wherein the skin protector is shown in the first state.

FIGS. 8 to 17 illustrate an exemplary embodiment and further aspects of the skin protector 76 and of a respective movement mechanism 100 that enables the self-adjustment or the self-set up of the skin protector 76. FIG. 8 and FIG. 9 illustrate a respective cross-sectional lateral side view that is taken along the line VIII-VIII indicated in FIG. 6. FIG. 10 and FIG. 11 illustrate a respective cross-sectional lateral side view taking along the line X-X in FIG. 6. FIG. 12 and FIG. 13 illustrate a respective perspective view of a lateral cross-section taking along the line XII-XII in FIG. 6. It goes without saying that the skilled person readily realizes that the positions of the respective cross-sections indicated in the perspective view of FIG. 6 are basically parallel to a plane that is defined by the longitudinal direction X and the height or vertical direction Y, refer also to the coordinate system X, Y, Z in FIG. 7. However, as FIG. 6 and FIG. 7 illustrate a perspective partial view of the cutting head 18, also the indicating lines VIII-VIII, X-X, and XII-XII are somewhat distorted due to their perspective view.

Figure 14:
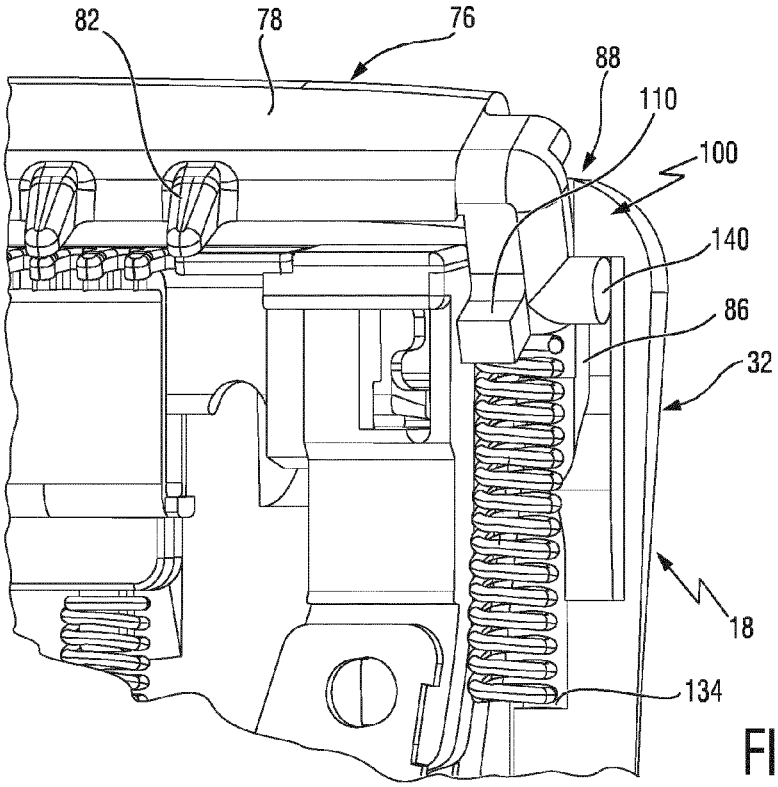
FIG. 14 is a partial, cross-sectional perspective longitudinal side view of a lateral end region of the arrangement of the cutting head illustrated in FIG. 6, wherein the skin protector is shown in the first state.
Figure 15:
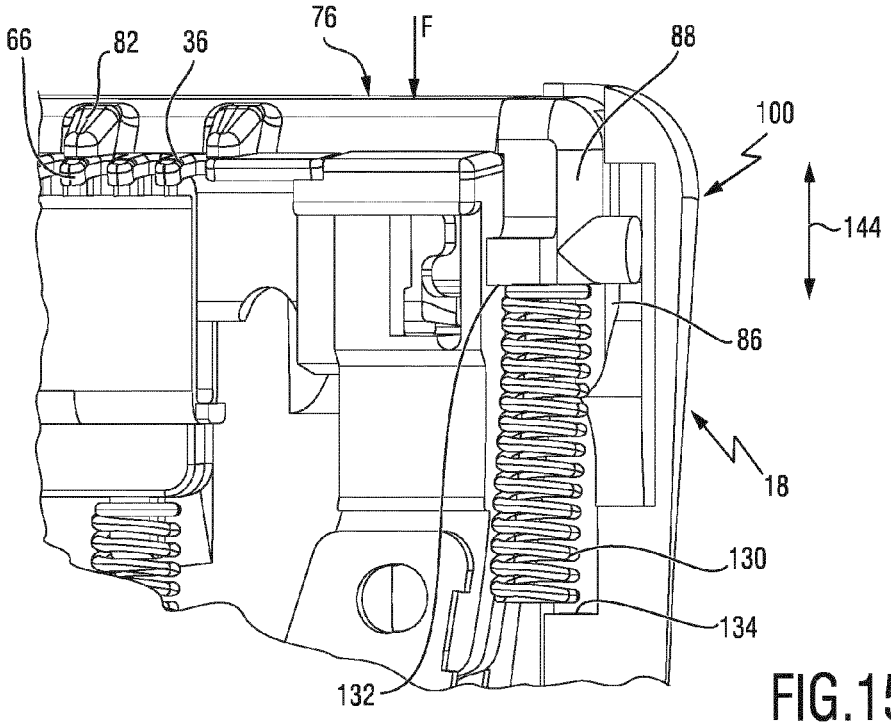
FIG. 15 is another partial, cross-sectional perspective longitudinal side view of the arrangement illustrated in FIG. 14, wherein the skin protector is shown in the second state.

The cross-sectional view of FIGS. 8 and 9 basically corresponds to the view of the blade set 20 illustrated in FIG. 4. In FIG. 8 and FIG. 9, the blade set 20 and the skin protector 76 are attached to the housing portion 32 and shown in an assembled state. The skin protector 76 is shown in FIG. 8 in a first state in an advanced position. The skin protector 76 is shown in FIG. 9 in a second state in a retracted position. Also, the illustrations of FIGS. 10, 12 and 14 illustrate the first state. Accordingly, FIGS. 11, 13 and 15 illustrate the second state.

Again, reference is made to FIG. 8 and FIG. 9. The main body 78 of the skin protector 76 comprises a frontal portion 92 and a leg portion 94 extending therefrom. In the second state, as shown in FIG. 9, the frontal portion 92 is arranged in a fashion basically parallel to the front face 58 of the stationary blade 36. At the rear or bottom side thereof, the main body 78, particularly the frontal portion 92 thereof, comprises a rear surface 96. The rear surface 96 may contact the front face 58 in the second state. As can be further seen from FIG. 9, the frontal portion 92 and the leg portion 94 may entirely cover one of the leading edges 22, 24 in the second state.

As indicated above, a movement mechanism 100 is provided to move or operate the skin protector 76 between the first state and the second state. By applying a force F to the skin protector 76, particularly by applying a force F that acts in the vertical direction Z to the main body 78 of the skin protector 76, the skin protector 76 may be urged into the second state. However, the actuating force F does not necessarily have to be perfectly parallel to the vertical direction Y. Typically, the actuating force F is indirectly caused by applying a contact force to the hair cutting appliance 10 to push the blade set 20 against the skin. A respective counterforce operates or actuates the self-adjusting skin protector 76.

In some exemplary embodiments, the skin protector 76 is not only (linearly) displaced or pivoted when being transferred between the first state and the second state. Rather, as indicated in FIG. 9 by double-arrows 102, 104, the movement of the skin protector 76 may be regarded as a combined movement comprising a linear component (arrow 102) and a swiveling component (arrow 104). To this end, the movement mechanism 100 is provided which is arranged to define a range and path of movement for the skin protector 76.

An exemplary embodiment of the movement mechanism 100 is elucidated hereinafter with reference to FIGS. 10 to 17. It goes without saying that further alternative embodiments may be envisaged that may use only some aspects of this embodiment. Generally, the movement mechanism 100 may be arranged as a coupling mechanism that defines the desired orientation of the skin protector 76 in the first state and in the second state. Preferably, the movement mechanism 100 further defines respective intermediate positions of the skin protector 76 when travelling between the first state and the second state. By way of example, the movement mechanism 100 may be arranged as a linkage mechanism, particularly a four joint mechanism. In the alternative, it may be sufficient that the movement mechanism 100 provides respective contact surfaces or abutment surfaces that define the respective position and/or orientation of the skin protector 76 in the first and the second state. When travelling between the first and the second state, it may be sufficient to at least approximately define a travel path. Consequently, to some extent, the travel path may be undetermined.

The embodiment of the movement mechanism 100 that is further illustrated in FIGS. 10 to 17 makes use of at least one orientation guiding element 110 that is arranged at a lateral end of the main body 78 of the skin protector 76. Preferably, two respective orientation guiding elements 110 are provided at the two opposite lateral ends of the skin protector 76. Each of the orientation guiding elements 110 may be arranged to cooperate with a guide block 112 that is arranged at the housing portion 32 of the cutting head 18. More generally, the guide block 112 may be directly or indirectly coupled to the stationary blade 36 of the blade set 20. Via the guide block 112, the skin protector 76 may assume defined positions (in the first state and the second state) with respect to the blade set 20.

As shown in FIG. 10 and FIG. 11, the orientation guiding element 110 may extend from the main body 78, and may comprise a basically L-shaped or Z-shaped lateral cross-section. A first leg 114 may extend from the main body 78, particularly perpendicular thereto. A second leg 116 may extend from the first leg 114, particularly perpendicular thereto or at a defined angle. Preferably, the first leg 114 and the second leg 116 are arranged at an angle to one another. As a consequence, a position and an orientation of the skin protector 76 in the first state and in the second state may be precisely defined.

Figure 16:
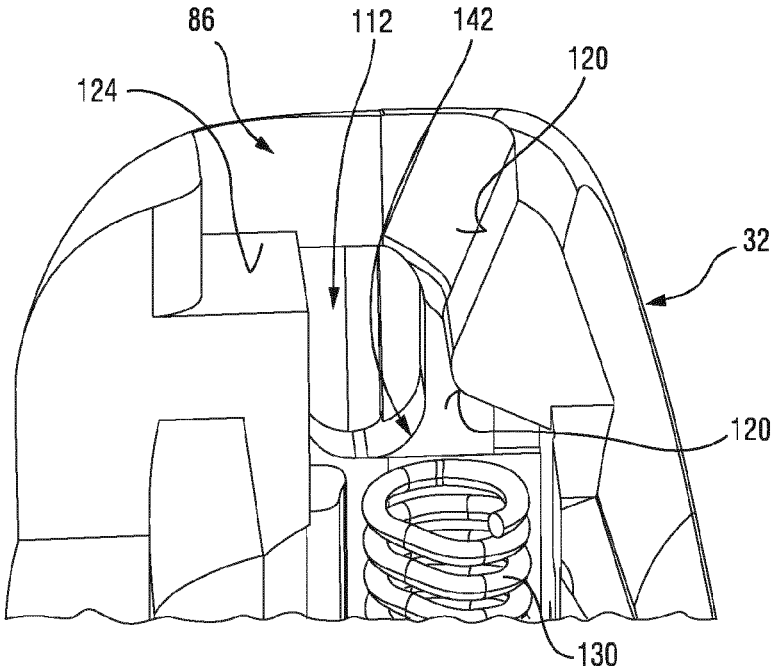
FIG. 16 is a perspective top view of a lateral end region of a housing portion of the cutting head illustrated in FIG. 6, wherein the blade set and the skin protector are not shown for illustrative purposes.

As can be best seen from FIG. 11, at the guide block 112, a first abutment surface 120 may be provided, refer also to FIG. 16. The first abutment surface 120 basically corresponds to a first contact surface 122 that is jointly defined by the first leg 114 and the second leg 116 of the orientation guiding element 110. The first abutment surface 120 and the first contact surface 122 may engage each other to define the position and orientation of the skin protector 76 in the first state. Furthermore, a second abutment surface 124 may be provided at the guide block 112. The second abutment surface 124 may basically correspond to a second contact surface 126 that is jointly defined by the first leg 114 of the orientation guiding element 110 and by the rear surface 96 (or the frontal portion 92) of the skin protector 76 (refer also to FIG. 8). The second abutment surface 124 and the second contact surface 126 may engage each other to define the position and the orientation of the skin protector 76 in the second state.

Furthermore, at least one biasing element 130, preferably two biasing elements 130 that are arranged at opposite lateral ends of the skin protector 76 may be provided. The at least one biasing element 130 urges the skin protector 76 from the second state into the first state. By applying a respective actuating force F, the biasing element 130 may be deformed. Consequently, a defined level of the actuation force needs to be applied to the skin protector 76 to entirely transfer the skin protector 76 from the first state to the second state. Several types of biasing elements 130 may be envisaged. As can be best seen in FIGS. 10, 11, 14 and 15, the biasing element may be arranged as a helical spring. The biasing element 130 may contact the skin protector 76 at a load receiving portion 132 that may be arranged at the orientation guiding element 110. Furthermore, at the housing portion 32, a receiving support 134 may be provided to receive the opposite end of the biasing element 130, refer also to FIG. 14 and to FIG. 15. In case no external actuation force F is applied to the skin protector 76, the biasing element 130 ensures that the skin protector 76 is positioned and oriented in the first state. By way of example, the biasing element 130 may be at least slightly biased or compressed in the first state. As a consequence, the actuation force F applied to the skin protector 70 has to exceed a threshold level to move the skin protector 76.

By adapting characteristics and properties of the biasing element 130, the response characteristics of the movement mechanism 100 for the skin protector 76 may be accurately defined.

A further refinement of the movement mechanism 100 is elucidated with further reference to FIGS. 12 and 13. Adjacent to the orientation guiding elements 110, at least one travel guiding element 140 may be provided. Preferably, two travel guiding elements 140 are provided that laterally extend from the orientation guiding elements 110 at the lateral ends of the skin protector 76. The travel guiding elements 140 may be arranged in a pin-like fashion. As can be best seen from FIGS. 12 and 13, the travel guiding elements 140 may be received, in the attached state of the skin protector 76, at respective guide slots 142. The guide slot 142 defines a direction of travel for the travel guiding element 140 that is indicated by a double-arrow 144 in FIG. 12. The first state of the skin protector 76 as shown in FIG. 12 corresponds to a top position of the travel guiding element 140 in the guide slot 142. The second state of the skin protector 76 illustrated in FIG. 13 corresponds to a low or rear position of the travel guiding element 140 in the guide slot 142. Also, the arrows 102, 104 that indicate components of the combined movement of the skin protector 76 are shown in FIG. 12, refer also to FIG. 9 in this context.

The combination of the orientation guiding element 110 and the guide block 112 as shown in FIGS. 10 and 11 and the travel guiding element 140 and the guide slot 142 shown in FIGS. 12 and 13, may be regarded as a particularly beneficial embodiment. Jointly, the respective pairs of guiding elements 110, 112 and 140, 142 precisely define the desired locations and orientations and the desired travel paths of the skin protector 76.

However, so as to avoid an overdetermined state of the movement mechanism 100, it may be further preferred to define the guide slot 142 in such a way that the travel guiding element 140 does not contact a respective front end or rear end thereof when the orientation guiding element 110 contacts the respective abutment surfaces 120, 124 in the first state and in the second state, respectively.

As can be best seen from FIGS. 14 and 15, the biasing element 130 may engage the skin protector 76 at the orientation guiding element 110 that may provide the respective load receiving portion 132. The load receiving portion 132 may be therefore laterally offset from the travel guiding element 140.

As can be further seen from FIGS. 14 and 15, the skin protector 76 may be secured or arranged in a loss-preventing fashion at the housing portion 32. This may be achieved for instance by the travel guiding elements 140 that may be arranged at their counterpart guide slots 142 in a positive-locking fashion. As a consequence, the skin protector 76 cannot be lifted from or brought out of engagement with the housing portion 32.

However, as indicated further above, the skin protector 76 may be alternatively arranged to be attached to the housing portion 32 in a releasable fashion. For instance, the skin protector 76 may be sufficiently deflectable or deformable so that the travel guiding elements 140 can be deliberately and repeatedly brought out of engagement with the guide slots 142 so that eventually the skin protector 76 may be removed from the housing portion 32.

Figure 17:
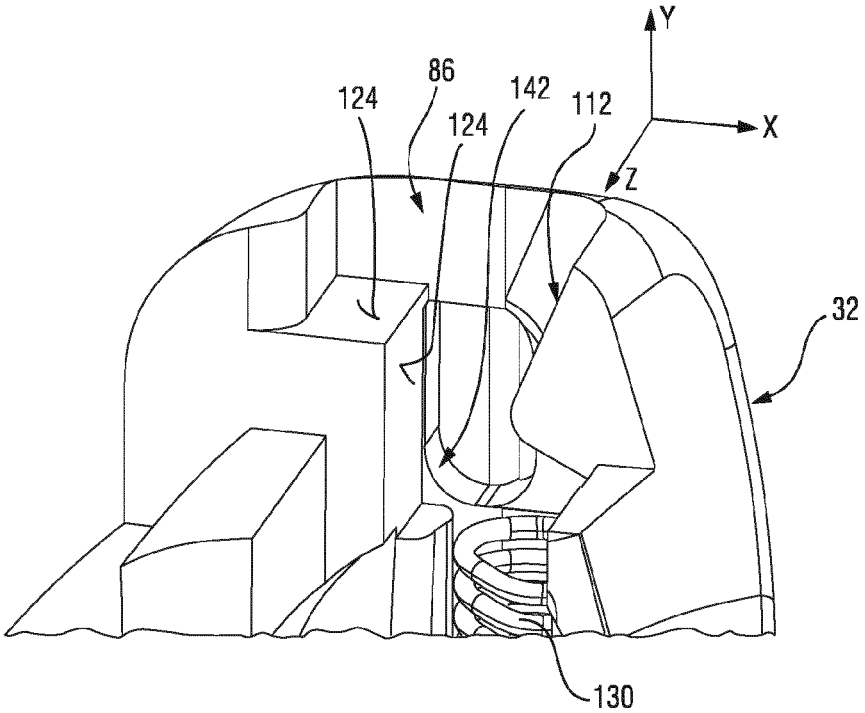
FIG. 17 is another perspective top view of the housing portion illustrated in FIG. 16, wherein the orientation of the view of FIG. 17 is slightly different from the orientation of the view of FIG. 16.

Further reference is made to FIGS. 16 and 17 illustrating respective perspective internal views of the housing portion 32, wherein the blade set 20 and the skin protector 76 are removed for illustrative purposes. As already indicated in FIGS. 12 and 13, the housing portion 32 may comprise a first housing component 148 and a second housing component 150 that may jointly define the guide slot 142, for instance. In alternative embodiments, the first housing component 148 and the second housing component 150 may jointly define the guide block 112, particularly the first abutment surface 120 and the second abutment surface 124. As can be further seen from FIGS. 16 and 17, the guide block 112 and the guide slot 142 may be arranged adjacent to each other in a laterally displaced fashion, refer also to the laterally displaced arrangement of the orientation guiding element 110 and the travel guiding element 140 as illustrated in FIGS. 14 and 15.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope.

The invention claimed is:

1. A cutting head for a hair cutting appliance, the cutting head comprising:

a blade set comprising a stationary blade and a cutter blade, the stationary blade and the cutter blade comprising at least one toothed leading edge jointly defined by respective teeth of the stationary blade and the cutter blade, the teeth of the stationary blade and the cutter blade extending in a longitudinal direction (X), wherein the stationary blade further comprises a front face, at the teeth thereof, the front face being arranged to face a user's skin, when in operation, and a skin protector coupled to a housing portion of the cutting head, wherein the skin protector at least partially covers the front face, the skin protector comprising a main body, wherein the skin protector is arranged to contact the skin, when in operation, wherein the skin protector is movable, in response to external forces applied thereto, between a first state and a second state with respect to the blade set, wherein the skin protector is arranged in an advanced position in the first state, wherein the skin protector is arranged in a retracted position in the second state, such that in the first state a greater portion of the blade set is covered by the skin protector compared to the second state wherein, in said second state, a greater portion of the blade set is exposed compared to the first state, and wherein the main body of the skin protector is inclined with respect to the front face of the stationary blade when the skin protector is positioned in the first state.

2. The cutting head as claimed in claim 1, further comprising a movement mechanism interposed between the skin protector and the housing portion, wherein the movement mechanism movably connects the housing portion and the skin protector.

3. The cutting head as claimed in claim 2, wherein the movement mechanism comprises at least one travel guiding element that is arranged at a lateral end of the skin protector, and wherein the at least one travel guiding element is arranged at a guide slot provided at the housing portion that defines an allowed direction of linear motion for the travel guiding element with respect to the housing portion.

4. The cutting head as claimed in claim 3, wherein the at least one travel guiding element comprises two travel guiding elements that are arranged at opposite lateral ends of the skin protector, and wherein the travel guiding elements secure the skin protector at the cutting head in a loss-preventing fashion.

5. The cutting head as claimed in claim 3, wherein the movement mechanism further comprises at least one orientation guiding element that is arranged adjacent to the at least one travel guiding element, and wherein the at least one orientation guiding element is received at a guide block provided at the housing portion that defines a first orientation of the skin protector in the first state, and a second orientation of the skin protector in the second state.

6. The cutting head as claimed in claim 5, wherein the guide block defines a first abutment surface that contacts a first contact surface of the orientation guiding element in the first state, and wherein the guide block defines a second abutment surface that contacts a second contact surface of the orientation guiding element in the second state.

7. The cutting head as claimed in claim 1, wherein the skin protector is movably arranged at the cutting head such that the skin protector, when moving between the first state and the second state, is pivoted and displaced relative to the blade set in a combined movement.

8. The cutting head as claimed in claim 1, further comprising at least one biasing element that is arranged to urge the skin protector into the first state.

9. The cutting head as claimed in claim 8, wherein the at least one biasing element generates a linear thrust component and a swiveling component that urge the skin protector into the first state.

10. The cutting head as claimed in claim 8, wherein the at least one biasing element comprises at least one spring element arranged to urge the skin protector into the first state.

11. The cutting head as claimed in claim 1, wherein, when moving between the first state and the second state, at least the position or the orientation of the skin protector with respect to the blade set is changed.

12. The cutting head as claimed in claim 1, wherein the skin protector is transferred from the first state to the second state by applying a contact force to the cutting head when the cutting head is moved along the skin.

13. The cutting head as claimed in claim 1, wherein the skin protector is, in the first state, arranged to prevent bulged soft skin portions from contacting cutting edges of the teeth of the stationary blade and the cutter blade, and wherein the skin protector is, in the second state, arranged to expose an increased portion of the front face of the stationary blade to increase cutting performance.

14. The cutting head as claimed in claim 1, wherein the skin protector comprises a plurality of guide teeth that are adapted to the teeth of the stationary blade, wherein the guide teeth extend laterally from a main body of the skin protector, and wherein the guide teeth extend over a lateral extension of the blade set.

15. A hair cutting appliance, comprising a cutting head having a blade set and a skin protector as claimed in claim 1.

16. The hair cutting appliance as claimed in claim 15, wherein the hair cutting appliance further comprises an electrically operated grooming appliance.

17. The cutting head as claimed in claim 1, wherein, when moving between the first state and the second state, the at least one toothed leading edge of the stationary blade and a corresponding leading edge of the skin protector maintain a substantially parallel relative orientation.

* * * * *